US006497526B2

(12) United States Patent
Weir

(10) Patent No.: US 6,497,526 B2
(45) Date of Patent: Dec. 24, 2002

(54) SCREWDRIVER FOR WALLBOARD SPOTTER

(76) Inventor: Stacey Weir, 3113 NE. 135$^{th}$ Ave., Vancouver, WA (US) 98682

( * ) Notice: Subject to any disclaimer, the term of this patent is extended or adjusted under 35 U.S.C. 154(b) by 0 days.

(21) Appl. No.: 09/827,717

(22) Filed: Apr. 5, 2001

(65) Prior Publication Data

US 2002/0146273 A1 Oct. 10, 2002

(51) Int. Cl.$^{7}$ ..... B43K 29/00
(52) U.S. Cl. ..... 401/195; 7/165; 81/60
(58) Field of Search ..... 401/195, 5, 52, 401/6; 7/165, 166, 105; 81/58, 60, 61, 62, 63, 63.1, 63.2; 16/405, 406, 422, 426, 427, 429

(56) References Cited

U.S. PATENT DOCUMENTS

| | | | |
|---|---|---|---|
| 2,092,586 A | 9/1937 | Naumovich | |
| 3,774,252 A | 11/1973 | Cantales | |
| 4,759,441 A | 7/1988 | Leurck | |
| 5,063,627 A | 11/1991 | Marra | |
| 5,137,386 A | 8/1992 | Mower | |
| 5,251,352 A | 10/1993 | Cullison | |
| 5,497,812 A | 3/1996 | Orosco et al. | |
| 5,575,030 A | 11/1996 | Girard | |
| 5,720,063 A | 2/1998 | Chacon | |
| 5,870,786 A | 2/1999 | Papadopoulos | |
| 5,894,624 A | 4/1999 | Fulenwider | |
| 6,006,384 A | 12/1999 | Toal | |
| 6,014,785 A | 1/2000 | Punch et al. | |
| 6,131,222 A | 10/2000 | Anderson et al. | |
| 6,272,708 B1 * | 8/2001 | Chen | 7/105 |
| 6,330,843 B1 * | 12/2001 | Lin | 81/63.1 |

* cited by examiner

*Primary Examiner*—David J. Walczak
(74) *Attorney, Agent, or Firm*—Klarquist Sparkman, LLP

(57) ABSTRACT

A multipurpose tool for use in installing wallboard is. According to one embodiment, the tool comprises an elongated handle having first and second ends. The first end of the handle is connected to a wallboard spotter. The second end of the handle is connected to a screwdriver portion, which desirably comprises a ratcheting screwdriver. The screwdriver portion can also be adapted to be removably coupled to the handle. In addition, the screwdriver portion can be provided with a removable, reversible bit having a screwdriver end and a blunt end for depressing strands of wallboard paper into holes left by nails or screws in wallboard. In another embodiment, a tool comprises an elongated handle having a first end adapted for connection to a conventional wallboard spotter and a second end having a screwdriver.

22 Claims, 6 Drawing Sheets

SCREWDRIVER FOR WALLBOARD SPOTTER

FIELD

The present invention relates to a multipurpose tool, and more particularly, to a wallboard spotter having an integral screwdriver.

BACKGROUND

Wallboard (also called drywall or sheet rock) is mounted to studs using screws. To ensure that the wall appears flush, the heads of the screws are sunk into the wallboard approximately ⅛ of an inch deep. A suitable mastic or joint compound is used to fill in the depressions left by the screws. The mastic is then sanded to ready the wall for painting or wallpaper.

Do-it-yourselfers typically use a putty knife to apply mastic in the depressions left by the screws. This is a relatively slow process. Professionals use a tool called a "nail spotter" or a "wallboard spotter" (more generically called a "spotter") that allows them to quickly fill the screws holes with mastic.

Spotters come in a variety of different styles and are sold by a number of different manufacturers. For example, Columbia Taping Tools (Blaine, Wash.), TapeTech (Union City, Calif.), Premier Drywall Tool Co. (Stockton, Calif.) and Ames Taping Tools (Duluth, Ga.) all make different versions of spotters that have slightly different designs and functional attributes. Reference can be had, for example, to U.S. Pat. No. 5,137,386, to Mower and U.S. Pat. No. 5,497,812, to Orosco et al. for a description of various spotters. In general, these wallboard spotters automatically dispense mastic or jointing compound to nail and screw depressions. Generally, the wallboard spotters have a cavity in which the compound is placed and a pressure plate or motorized mechanism is used to force the compound through an orifice to apply the compound to the wallboard.

A professional using a nail spotter occasionally comes across a screw that is insufficiently embedded or otherwise protruding from the wall. In such a case, the professional has to stop, take out a screwdriver and tighten the screw, before continuing use of the spotter. This process of using a separate screwdriver slows the professional down and disrupts the flow of applying mastic using the nail spotter.

During the installation of wallboard, it may be necessary to remove screws from a wallboard panel for various reasons. Removing screws from wallboard, however, may cause a portion of the paper surface of the wallboard to partially tear away from the surface. One way of treating the torn surface is to depress or push the paper strands into the hole left by the screw with a hand punch tool. Again, the process of using a separate tool, this time for treating a tom surface, further slows the professional down during the installation of wallboard.

SUMMARY

The present invention is directed to a multipurpose tool that is typically used in conjunction with wallboard spotters.

According to one embodiment, a multipurpose tool comprises a screwdriver portion and a wallboard spotter portion for automatically dispensing mastic or compound to a wall by forcing the mastic or compound from a housing. In one illustrated example, the tool includes an elongated handle having opposed first and second ends. The wallboard spotter portion may be connected in any suitable manner to the first end of the handle. The screwdriver portion may be, for example, connected in a suitable manner to the second end of the handle.

The screwdriver portion may be a ratcheting screwdriver. The screwdriver portion can also be adapted to be removably coupled to the handle to permit use of the screwdriver independent of the wallboard spotter portion and the handle. In addition, the screwdriver portion can be provided with a removable, reversible bit having a screwdriver end and a blunt end for depressing partially torn strands of wallboard paper into holes left by nails or screws in wallboard.

This tool is advantageous in that a worker using the tool to apply mastic to a wall panel does not have to stop work to take out a screwdriver if and when the worker comes across a screw that is not sufficiently embedded in the wall. Instead, the worker can utilize the screwdriver portion of the tool to further drive or tighten the screw into the wall. If the screwdriver portion is adapted to be removable, the worker can remove the screwdriver portion for use and then quickly re-attach it before continuing the mastic applying process. In either case, the tool facilitates the installation of wallboard and reduces the time required for the application of mastic.

In another embodiment, a tool comprises an elongated handle having first and second ends. The first end of the handle is adapted for connection to a conventional wallboard spotter for automatically dispensing mastic or compound to a wall by forcing the mastic or compound from a housing. The second end of the handle is connected in any suitable manner to a screwdriver portion. Thus, in this particular example, the tool in one sense is a retrofit handle for a conventional wallboard spotter. A user can simply remove the existing handle of his wallboard spotter and connect the retrofit handle so as to form a tool having both a wallboard spotter and a screwdriver.

According to another embodiment, a multipurpose tool comprises a paper-pushing or hand punch portion for pushing torn strands of wallboard paper into holes left by nails or screws in wallboard. The hand punch portion is coupled to a wallboard spotter portion for applying mastic or compound to a wall. In one particular example, the tool includes an elongated handle, one end of which is connected in any suitable manner to the wallboard spotter portion and the other end of which is connected in any suitable manner to the paper pushing portion.

In yet another embodiment, a tool for installing and/or repairing wallboard comprises a main handle portion having first and second ends. The first end is connected in any suitable manner to an applicator end portion for storing and applying mastic or compound to wallboard. The second end of the handle is adapted to receive a conventional screwdriver.

According to one approach, a method of using a multipurpose tool for applying mastic or compound to a wall comprises applying mastic or compound to a wall using an automated wallboard spotter attached to one end of an elongated handle. Upon detecting a screw protruding from the wall, the elongated handle may be rotated or flipped from a wallboard-spotting position to a screw-tightening position wherein the end of the handle opposite the wallboard spotter is adjacent the protruding screw. The screw may then be tightened using a screwdriver coupled to the elongated handle opposite the wallboard spotter. After tightening the screw, the handle may be rotated back to its wallboard-spotting position so that the wallboard spotter can be used to apply mastic or compound. Consequently, rotation of the elongated handle back and forth between the screw-tightening position and the wall-spotting position may be accomplished without adjusting the user's hands on the handle.

The foregoing and other objects, features, and advantages of the invention will become more apparent from the following detailed description of several embodiments, which proceed with reference to the accompanying figures.

DETAILED DESCRIPTION

Figure 1:
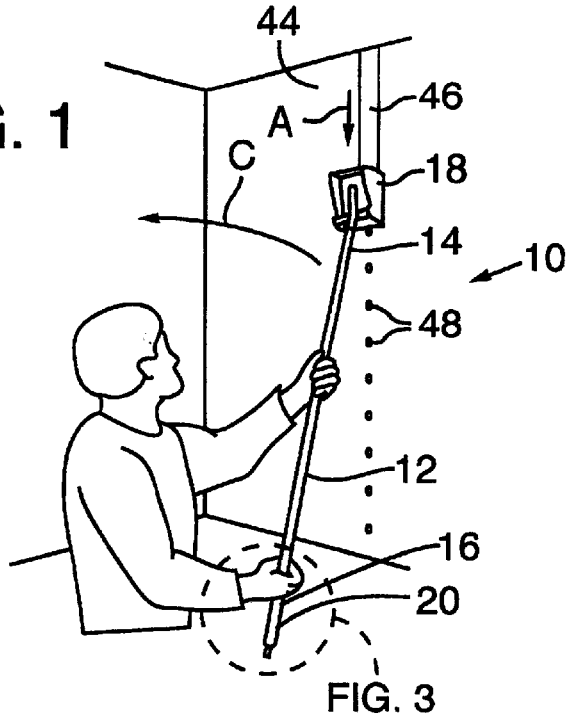
FIG. 1 illustrates a worker using a multipurpose tool to install wallboard.

Referring to FIG. 1, there is shown a worker using a multipurpose tool 10 in a wall-board spotting position by holding an elongated handle 12 having a first end 14 and a second end 16. The first end 14 of the handle 12 is coupled in any convenient manner to a wallboard spotter or applicator end portion 18 for applying mastic or joint compound to a wall panel. The wallboard spotter portion 18 may be, for example, a conventional wallboard spotter or nail spotter. The second end 16 of the handle 12 is coupled in any convenient manner to a screwdriver portion 20.

Figure 2:
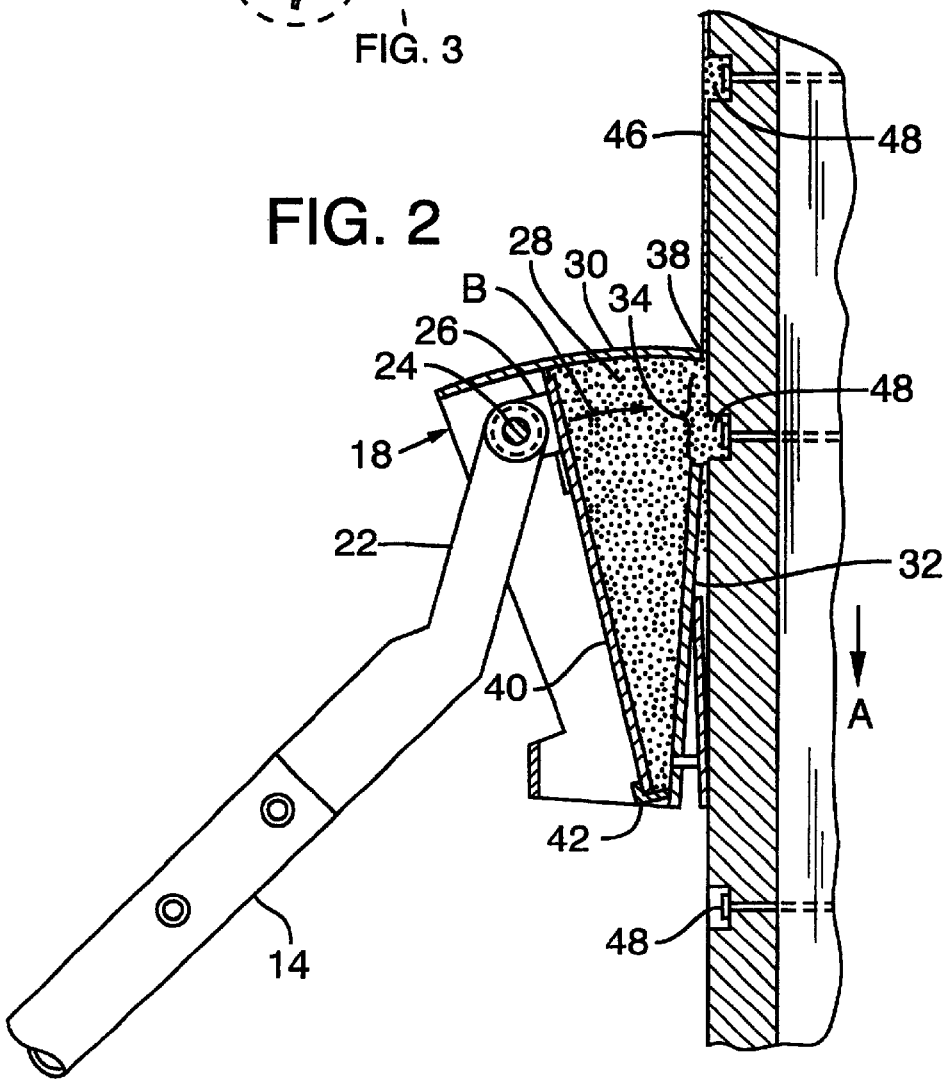
FIG. 2 is a cross-sectional view of one example of a wallboard spotter portion for the multipurpose tool of FIG. 1.

FIG. 2 shows one example of a wallboard spotter portion 18. In this embodiment, the first end 14 of the handle 12 terminates at an angled extension 22. A bolt 24 extends through a bolt hole in the outer end of extension 22 and a corresponding bolt hole in an ear 26 of the spotter portion 18 so as to permit pivoting of the spotter portion 1 8 relative to the handle 12. In addition to the specific spotter portion 18 shown in FIG. 2, the first end 14 of the handle 12 can be adapted for connection to any commercially available wallboard spotter.

The illustrated spotter portion 18 includes a housing 30 defining an internal cavity, which may be filled with mastic or joint compound 28. An orifice 34 is defined in a base plate 32 of the housing 30. A pressure plate 40 is pivoted at 42 to swing toward the base plate 32 in the direction of arrow B for squeezing the mastic 28 out of the orifice 34 as the tool 10 is moved in the direction of arrow A. A blade, indicated at 38, spreads and levels the mastic 28 as it is deposited on the wall. Of course, various other forms of wallboard spotters may be substituted for the illustrated wallboard spotter. The wall-board spotter automatically dispenses the mastic or joint compound by applying pressure on the mastic or joint compound via a pressure plate or some other mechanical or motorized means as is well understood in the art.

Referring again to FIG. 1, the tool 10 may be used to apply mastic to a wallboard panel in the following manner. A worker holds the wallboard spotter portion 18 of the tool 10 against a wall panel 44, comprising, for example, wallboard or drywall, and pulls it along the wallboard in a downward direction (as indicated by arrow A). As it is so pulled, a layer 46 of mastic 28 is spread over a row of nail or screw holes 48. As best shown in FIG. 2, the mastic 28 fills the holes 48 as the blade 38 scrapes away the excess mastic off the wall, leaving the holes 48 filled with little or no excess mastic on the surface of the wall.

If the worker comes across a screw that is protruding from the wall, the worker can simply rotate or flip the handle in the direction indicated by arrow C to a screw-tightening position wherein the screwdriver portion 20 is in position to tighten the screw. When switching to the screw-tightening position, the worker does not need to change the position of his hands or release the handle. Once the screw is properly embedded in the wallboard, the worker can rotate or flip the handle back to the wall-spotting position and continue to apply the mastic. Thus, a worker can tighten screws with minimal interruption to the wall-spotting process. If, as explained below, the screwdriver portion is a ratcheting type screwdriver, the worker can flip the handle to the screw-tightening position, tighten the screw and then flip the handle back to the wall spotting position without ever adjusting the position of his hands relative to the handle.

Figure 4:
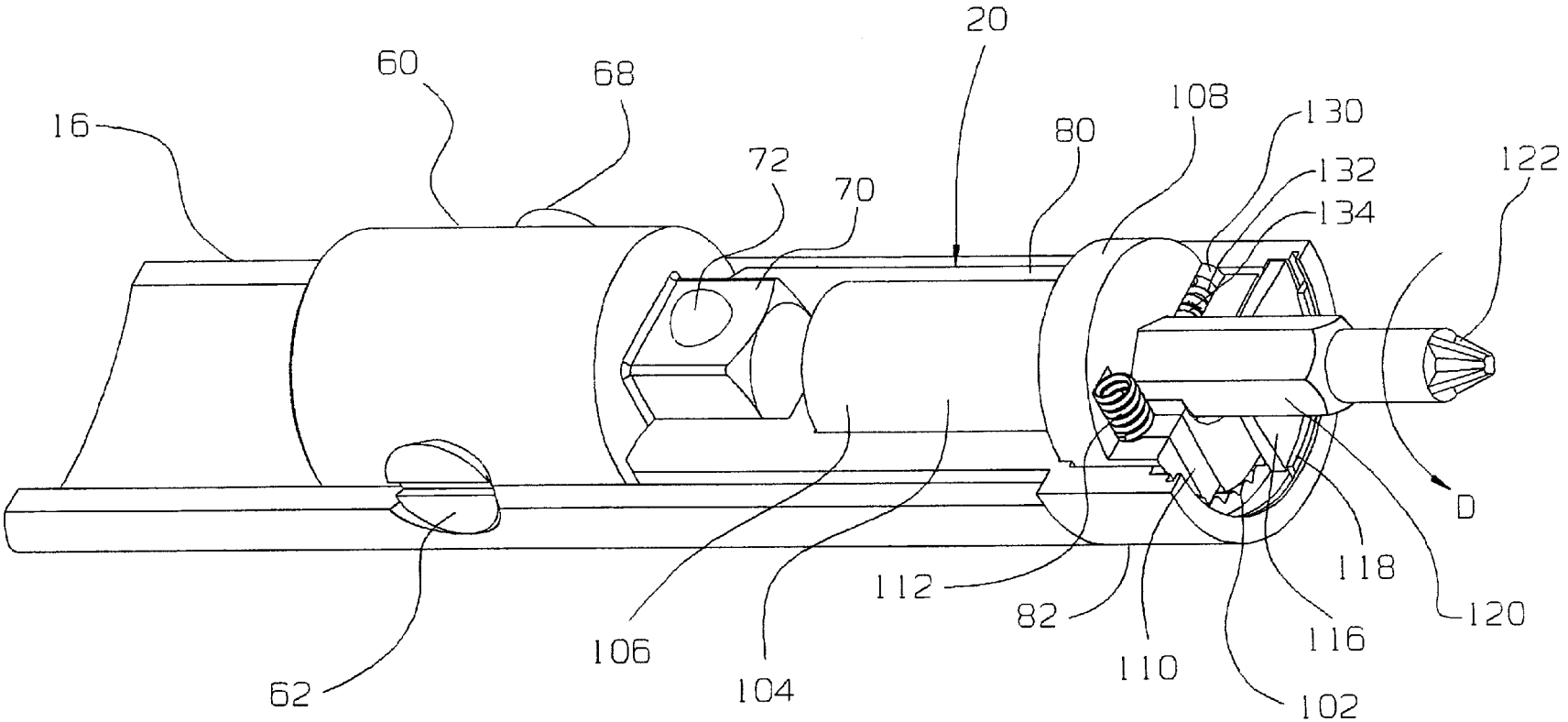
FIG. 4 is an enlarged, cut-away, perspective view of the screwdriver portion of FIG. 3.
Figure 5:
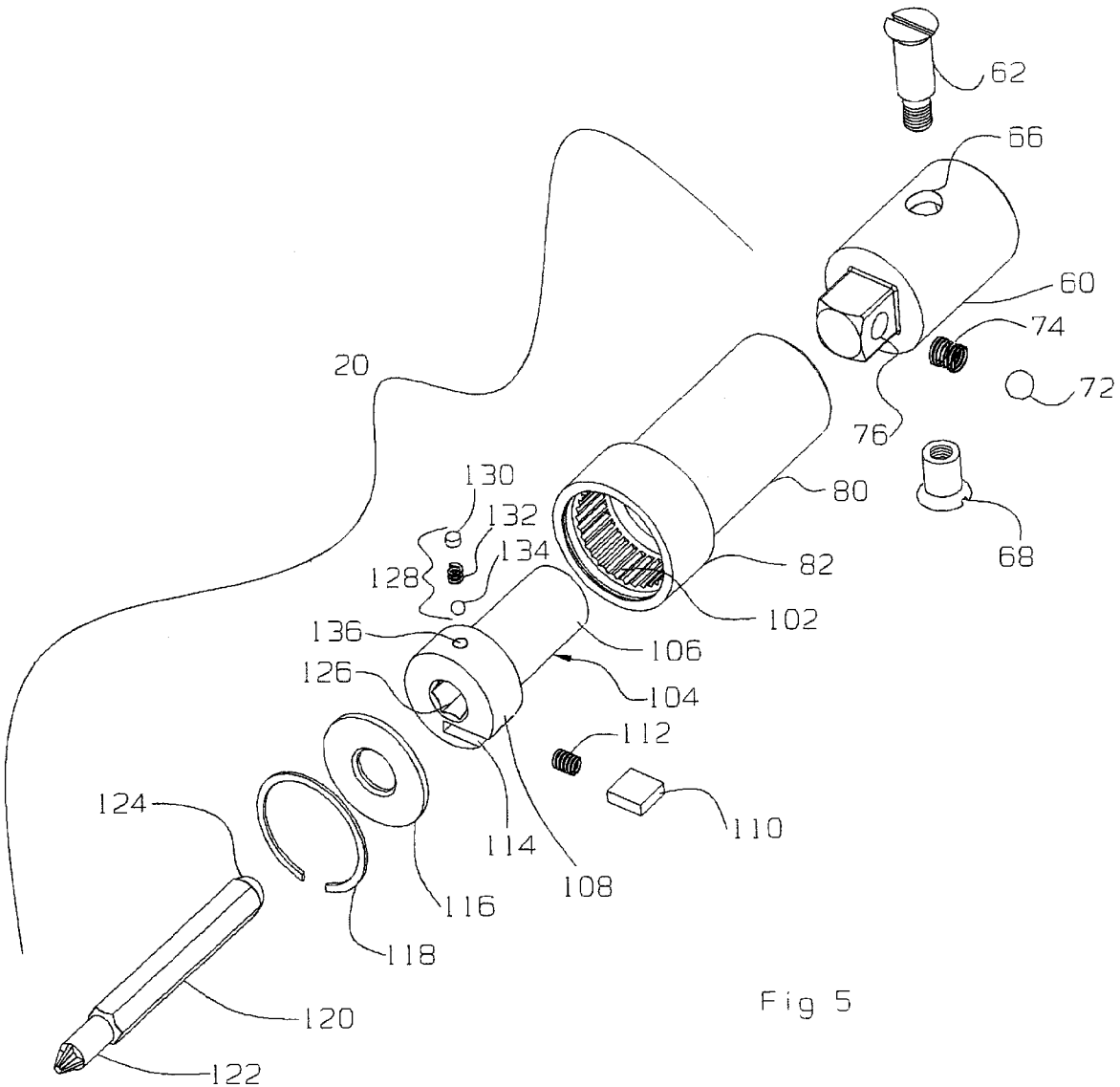
FIG. 5 is an enlarged, exploded view of the screwdriver portion of FIG. 3.
Figure 6:
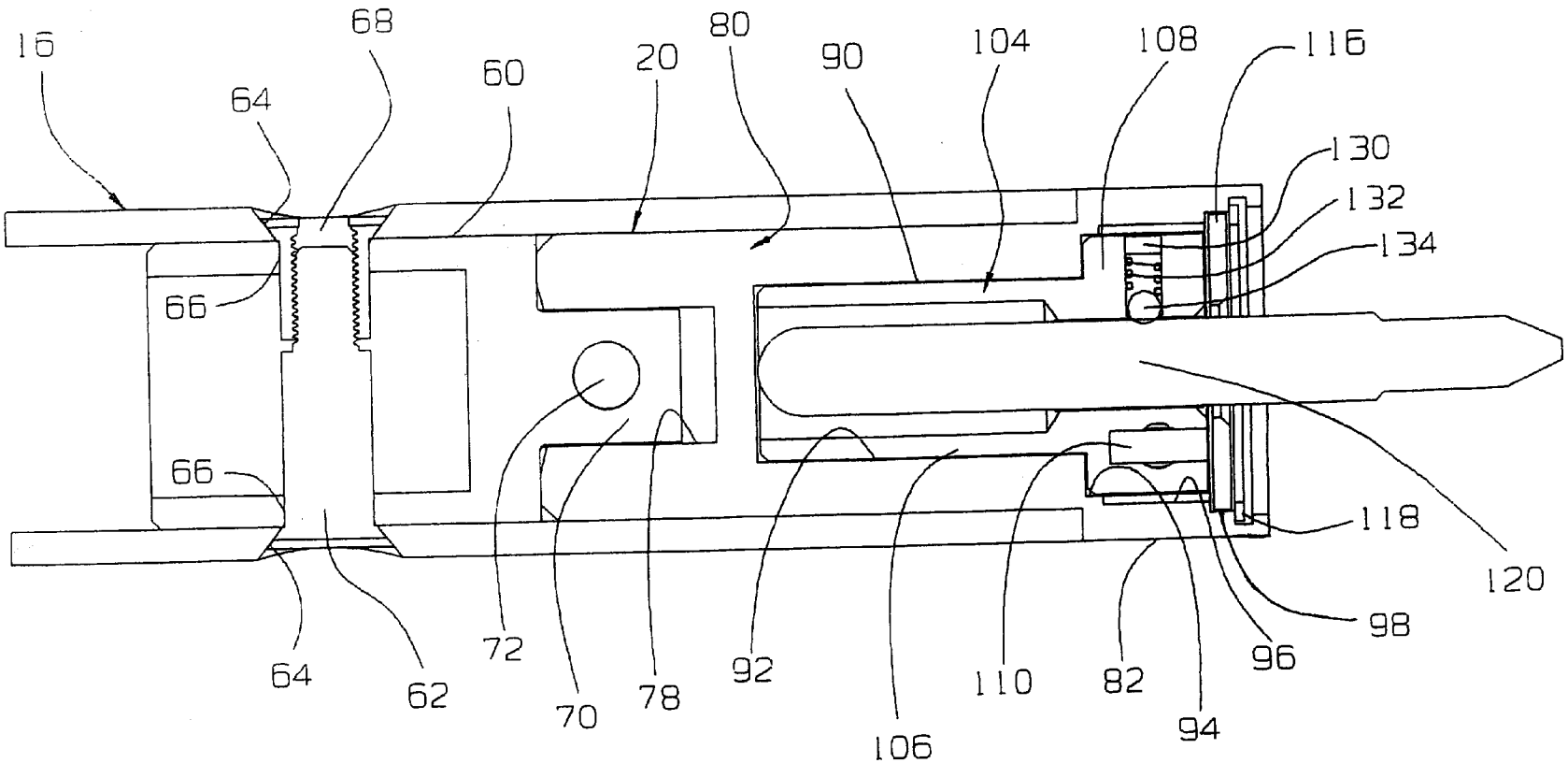
FIG. 6 is an enlarged, cross-sectional view of the screwdriver portion of FIG. 3 taken along line 6—6.

The illustrated screwdriver portion 20 is a ratcheting type screwdriver In addition, the screwdriver portion 20 may be adapted to be removably coupled to the second end 16 of the handle 12. Referring then to FIGS. 3–6, there is shown an exemplary embodiment of the screwdriver portion 20. The screwdriver portion 20 in this example comprises a ratchet body 80 sized to be inserted into the second end 16 of the handle 12. As best shown in FIG. 6, the ratchet body 80 has an axially extending, cylindrical bore 90. The bore 90 has a plurality of cylindrical portions 92, 94, 96 and 98 of gradually increasing diameter, so as to form a substantially stepped cylindrical bore. A plurality of axially extending grooves or splines 102 (FIG. 5) are formed along the circumference of the surface of cylindrical portion 96.

The illustrated screwdriver portion further includes a ratchet spindle 104 positioned coaxially within the bore 90 of the ratchet body 80. The ratchet spindle 104 has first and second portions 106 and 108, respectively, which are generally cylindrical. As best shown in FIG. 6, the first portion 106 of the spindle is positioned in cylindrical portion 92 of bore 90. The second portion 108 of the spindle is positioned partially in cylindrical portion 94 and cylindrical portion 96 of bore 90. The outer diameter of the second portion 108 of the spindle is such that there is provided a small gap between the surfaces of the second portion 108 and cylindrical portion 96 of bore 90. A washer 116 seats in cylindrical portion 98 of bore 90 and a snap ring 118 is positioned in a circumferentially extending slot adjacent cylindrical portion 98 to retain the spindle 104 in the ratchet body 80.

The screwdriver portion 20 is configured to carry a screwdriver bit 120. In the illustrated form, the bit is removable and reversible and is configured to be slidably inserted into a similarly shaped, axially extending bore 126 in the spindle 104. The bit 120 can be retained in the bore 126 in any suitable manner, such as with a bit retaining mechanism 128 (FIG. 5). The bit retaining mechanism 128 includes a plug 130, a biasing spring 132 and a ball 134 received in a radially extending bore 136 in the second portion 108 of the spindle. The plug 130 forms a press fit in the bore 136 to retain the spring 132 and ball 134 therein. The spring 132 biases the ball 134 inwardly radially to engage the bit 120. The bit 120 may be retained in the bore 126 in any other suitable manner, such as by a magnet positioned in the bore.

The illustrated reversible bit 120 includes a screwdriver end 122 for driving a Phillips type screw and a blunt end 124 (such as provided in a hand punch tool). The blunt end 124 is desirably sized to be inserted into a hole created by a drywall screw or nail. As such, a worker can use the blunt end 124, for example, to push or depress strands of partially torn wallboard paper into holes left by previously removed screws or nails. Various designs of bits are well known in the art and may be substituted for the bit shown. Without limitation, other examples include a flat head type bit (i.e., a straight blade bit), an Allen wrench bit, or any other bit for driving a fastener. The bit also may be permanently attached to the screwdriver portion 20. In addition, a bit having a screwdriver end and without a blunt end may be used, or alternatively, a bit having blunt end and without a screwdriver end may be used.

A biasing spring 112 and paw 110 are received in a slot 114 formed in the second portion 108 of the spindle 104. As shown in FIG. 4, the spring 112 biases the paw outwardly to engage the splines 102. Thus, it can be seen that rotation of the ratchet body 80 in the clockwise direction, as viewed from the handle end of the tool 10, (as indicated by arrow D in FIG. 4), causes rotation of spindle 104 and bit 120 to drive a fastener. When the ratchet body 80 is rotated in the counterclockwise direction, however, the paw 110 is caused to move away from the splines 102 to permit ratcheting of the ratchet body 80 relative to the spindle 104. The screwdriver portion 20 may also be configured to permit ratcheting in the clockwise direction to facilitate removal or loosening of a fastener.

As mentioned above, the illustrated screwdriver portion 20 is adapted to be removably coupled from the second end 16 of the handle 12. In the illustrated embodiment, for example, the second end 16 has a hollow interior cavity in which there is positioned a screwdriver receiver mechanism 60 for engaging the ratchet body 80 of the screwdriver portion 20 (as best shown in FIG. 4). The screwdriver receiver mechanism 60 is secured within the interior cavity of the second end 16 is any suitable manner, such as by a bolt 62 extended through holes 64 in the second end 16 of the handle and corresponding holes 66 in the screwdriver receiver mechanism (as best shown in FIG. 6). The bolt 62 may be tightened into a threaded cap 68 at its outer end. The receiver mechanism 60 may be secured to the second end 16 of the handle in other ways. For example, the receiver mechanism 60 may be threaded into the second end 16 or it may be molded into the second end 16.

The screwdriver receiving mechanism 60 includes a longitudinally extending projection 70. Projection 70 may be, for example, a ⅜ inch male socket. Projection 70 is adapted to engage a similarly shaped bore 78, such as a ⅜ female socket, formed in the ratchet body 80 (FIGS. 4 and 6). As best shown in FIG. 5, a bore 76 in the projection 70 retains a ball 72 and a biasing spring 74. The spring 74 biases the ball 72 outwardly to engage a side surface of the bore 78 to retain the ratchet body 80. Optionally, a ball receiving depression (not shown) may be formed in one of the side surfaces of the bore 78 to receive the ball 72.

An outer end portion 82 of the ratchet body 80 resides outside the interior of the second end portion 16. Thus, it can be seen that the ratchet body 80 can be removed from the second end 16 of the handle 12 by grasping the outer end portion 82 of the ratchet body 80 and pulling in a direction away from the second end portion 16. Once removed, the screwdriver portion 20 can be used independently of the handle 12 with the ratchet body 80 becoming a handle for the screwdriver portion 20.

Figure 3:
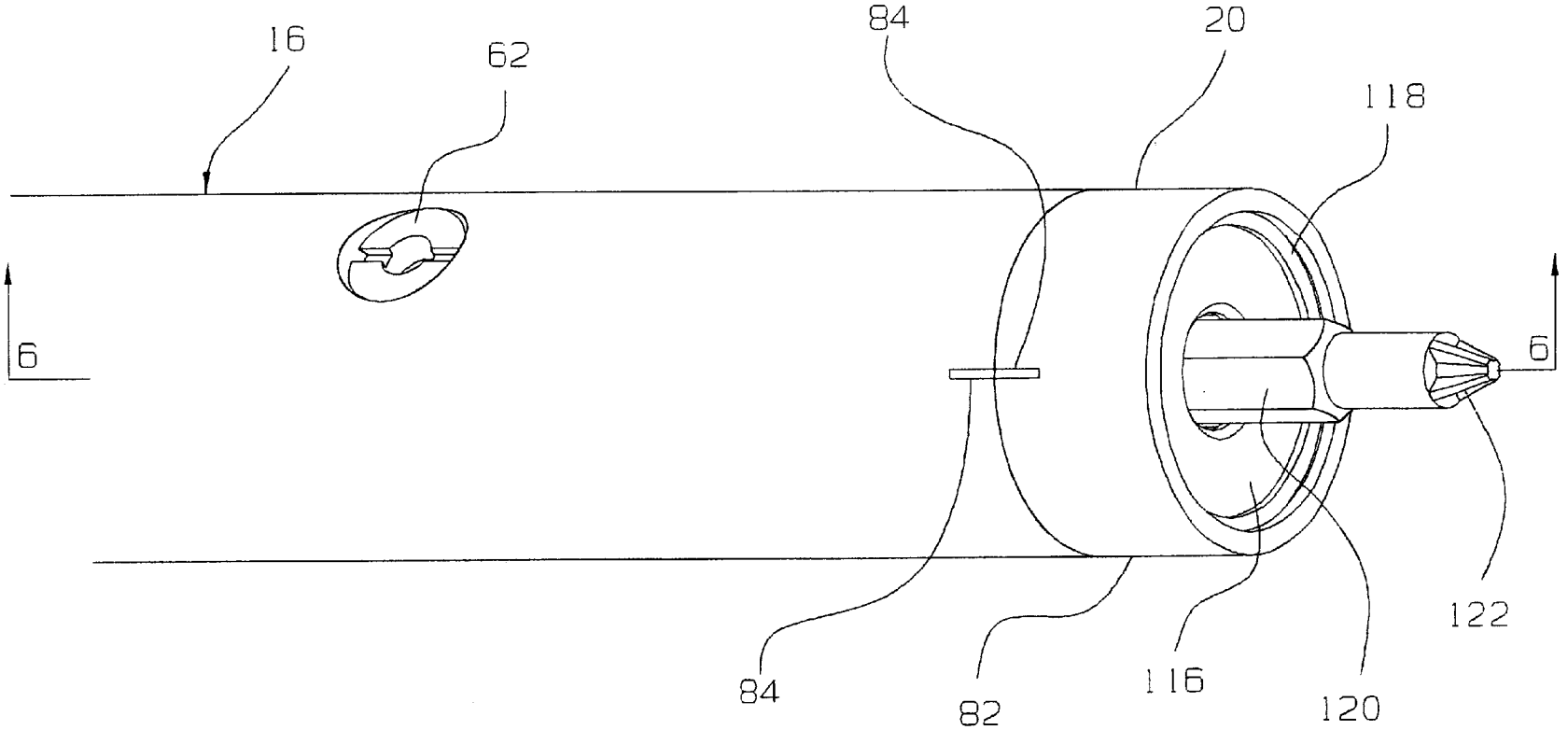
FIG. 3 is an enlarged perspective view of an exemplary screwdriver portion for the multipurpose tool of FIG. 1.

The screwdriver portion 20 can then be re-attached to the handle 12 by inserting the ratchet body 80 into the interior of the second end 16 with bore 78 being properly aligned with the projection 70 and pressing inwardly until the projection 70 fully engages the bore 78. As shown in FIG. 3, visual indicia, such as grooves 84, can be provided on the outer surfaces of the second end 16 and the outer end portion 82 of the ratchet body 80 to provide a user with visual indication of the proper alignment for the projection 70 and the bore 78.

Figure 7A:
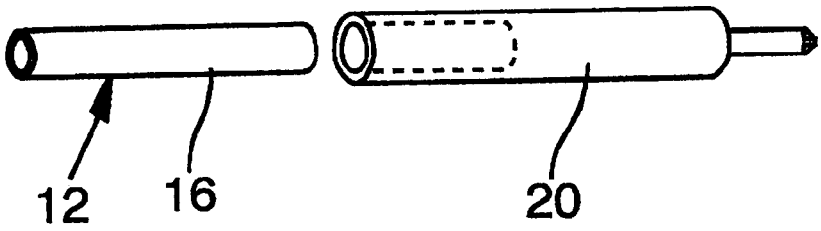
FIG. 7A is a perspective view of a screwdriver having a handle formed with a bore for receiving the handle of the multipurpose tool.
Figure 7B:
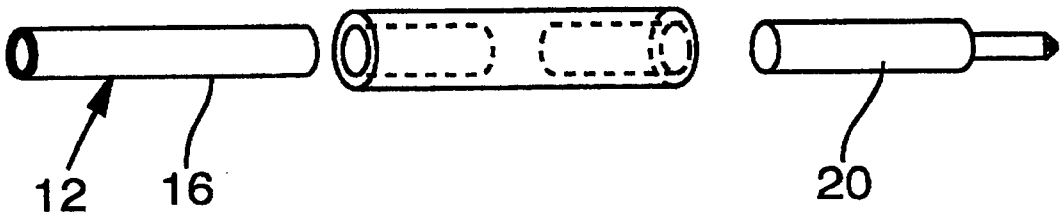
FIG. 7B is a perspective view of a double-ended sleeve formed with two opposing, longitudinally extending bores for coupling a screwdriver to the handle of the multipurpose tool.

In addition to the specific example shown, the screwdriver portion 20 can be coupled to the second end 16 of the handle 12 in a variety of ways. For example, the screwdriver portion 20 may be permanently attached to the second end 16 of the handle 12. In another example, the second end 16 of the handle 12 may be adapted to receive a conventional, non-ratcheting screwdriver or a battery powered screwdriver. In yet another example, the handle of a screwdriver may be provided with a bore to receive therein the second end 16 of the handle 12 (FIG. 7A). Alternatively, a double-ended sleeve may be used to couple a screwdriver such as screwdriver portion 20 to the second end 16 of the handle. Such a double-ended sleeve may comprise two opposing longitudinally extending bores wherein one bore receives the screwdriver and the other bore receives the second end 16 (FIG. 7B). The screwdriver and second end can be secured in their respective bores in any suitable manner, such as by creating a frictional fit with their respective bores or with a conventional mechanical fastener such as a bolt or screw. Still alternatively, the screwdriver portion 20 may be removably or permanently coupled to a position on the handle 12 other than end portion 16.

A cap (not shown) can be provided to cover the exposed end of the screwdriver bit 120 when the screwdriver portion is not being used.

The present invention has been shown in the described embodiments for illustrative purposes only. The present invention may be subject to many modifications and changes without departing from the spirit or essential characteristics thereof. I therefore claim as my invention all such modifications as come within the spirit and scope of the following claims.

I claim:

1. A multipurpose tool comprising:

a wallboard spotter portion for automatically dispensing mastic or compound to a wall;

an elongated handled having opposing first and second ends with the wallboard spotter coupled to one of the ends; and a screwdriver portion coupled to the end of the handle opposite the wallboard spotter, wherein the screwdriver portion comprises a ratcheting screwdriver.

2. The tool of claim 1 wherein the wallboard spotter portion includes a housing for storing mastic or compound.

3. The tool of claim 1 wherein the screwdriver portion is removably coupled to the second end of the handle.

4. The tool of claim 1 wherein the screwdriver portion has a removable, reversible bit having a screwdriver end and a blunt end for depressing partially torn strands of wallboard paper into holes left by nails or screws in wallboard.

5. A multipurpose tool comprising:

an elongated handle having first and second ends, the handle being of sufficient length to permit a user to grasp the handle with two hands to operate the tool;

the first end being adapted to connect to a wallboard spotter that automatically dispenses mastic or compound to a wall; and a screwdriver portion coupled to the second end of the handle and being operable for use while so coupled to the second end.

6. The tool of claim 5 wherein the screwdriver portion is removably coupled to the second end of the handle so that the screwdriver portion can be removed from and used independently of the handle.

7. The tool of claim 5 wherein the screwdriver portion comprises a screwdriver handle removably coupled to the second end of the handle and a screwdriver bit connected to the screwdriver handle.

8. The tool of claim 5 wherein the screwdriver portion has a removable, reversible bit having a screwdriver end and a blunt end for depressing strands of wallboard paper into holes left by nails or screws in wallboard.

9. The tool of claim 5 wherein the screwdriver portion has a longitudinally extending bore and the second end of the handle is removably and slidably insertable into the bore for connection therewith.

10. The tool of claim 5 wherein the screwdriver portion is coupled to the second end of the handle with a sleeve having first and second opposed, longitudinally extending bores, the first bore for receiving the screwdriver portion and the second bore for receiving the second end of the handle.

11. A multipurpose tool comprising:

means for automatically dispensing mastic or compound to wallboard; and means for driving screws into wallboard, the means for driving being coupled to the means for applying mastic or compound to wallboard;

wherein the means for automatically dispensing mastic or compound and the means for driving screws into wallboard can be used while coupled to each other.

12. The tool of claim 11 wherein means for applying mastic or compound to wallboard comprises a wallboard spotter.

13. The tool of claim 11 wherein the means for driving comprises a ratcheting screwdriver.

14. The tool of claim 13 further comprising an elongated handle having first and second ends, the first end connected to the means for applying mastic or compound to wallboard, the second end removably coupled to the screwdriver.

15. A method of using a multipurpose tool having an elongated handle, an automated wallboard spotter coupled to one end of the handle, and a screwdriver coupled to the opposite end of the handle, the method comprising:

applying mastic or compound to a wall using the wallboard spotter;

upon detecting a screw protruding from the wall, rotating the elongated handle from a wallboard-spotting position to a screw-tightening position so that the screwdriver is adjacent the protruding screw;

tightening the screw with the screwdriver by turning the handle; and after tightening the screw, rotating the handle back to its wallboard-spotting position so that the wallboard spotter can be used to apply mastic or compound.

16. The method of claim 15, wherein applying the mastic includes a user holding the handle with two hands and wherein rotating the elongated handle is accomplished without adjusting the user's hands on the handle.

17. The method of claim 15, further including removing the screwdriver from the elongated handle.

18. The method of claim 15, further including reversing a bit on the screwdriver so that a hand punch portion end of the screwdriver protrudes from the end of the handle opposite the wallboard spotter.

19. A multipurpose tool comprising:

an elongated handle having first and second ends;

the first end being adapted to connect to a wallboard spotter that automatically dispenses mastic or compound to a wall;

a screwdriver portion; and a sleeve coupling the screwdriver portion to the second end of the handle such that the screwdriver can be operated by turning the handle.

20. The tool of claim 19 wherein the sleeve comprises first and second opposing bores, the first bore for receiving the screwdriver portion and the second bore for receiving the second end of the handle.

21. A method for assembling a multipurpose tool, comprising:

providing a wallboard spotter comprising an elongated handle with first and second ends and an applicator end portion coupled to the first end of the handle, the applicator end portion configured to store and automatically dispense mastic or compound on wallboard; and coupling a screwdriver to the second end of the handle, wherein coupling a screwdriver to the second end of the handle comprises coupling a screwdriver to the second end of the handle such that the screwdriver can be used by turning the handle.

22. A method for assembling a multipurpose tool, comprising:

providing a wallboard spotter comprising an elongated handle with first and second ends and an applicator end portion coupled to the first end of the handle, the applicator end portion configured to store and automatically dispense mastic or compound on wallboard; and coupling a screwdriver to the second end of the handle, wherein coupling a screwdriver to the second end of the handle comprises slidably inserting a screwdriver into a bore of the second end of the handle such that the blade of the screwdriver is exposed for use.

* * * * *